US005905012A

United States Patent [19]

De Meutter et al.

[11] Patent Number: 5,905,012

[45] Date of Patent: May 18, 1999

[54] RADIATION CURABLE TONER PARTICLES

[75] Inventors: Stefaan De Meutter, Antwerpen; Serge Tavernier, Lint; Danny Van Wunsel, Westerlo, all of Belgium

[73] Assignee: Agfa-Gevaert, N.V., Mortsel, Belgium

[21] Appl. No.: 08/895,904

[22] Filed: Jul. 17, 1997

Related U.S. Application Data

[60] Provisional application No. 60/027,101, Sep. 25, 1996.

[30] Foreign Application Priority Data

Jul. 26, 1996 [EP] European Pat. Off. ..... 96202126

[51] Int. Cl.[6] ..... G03G 13/20

[52] U.S. Cl. ..... 430/124; 430/110

[58] Field of Search ..... 430/110, 97, 124

[56] References Cited

U.S. PATENT DOCUMENTS

| | | | |
|---|---|---|---|
| 3,723,114 | 3/1973 | Hagenbach et al. | 96/1.4 |
| 5,212,526 | 5/1993 | Domoto et al. | 355/271 |
| 5,250,387 | 10/1993 | Held et al. | 430/97 |
| 5,466,556 | 11/1995 | Inaishi | 430/138 |
| 5,470,683 | 11/1995 | Inaishi | 430/106 |
| 5,614,126 | 3/1997 | Gruber et al. | 525/438 |

FOREIGN PATENT DOCUMENTS

| | | | |
|---|---|---|---|
| 0 250 139 | 12/1987 | European Pat. Off. . | |
| 0 344 308 | 12/1989 | European Pat. Off. . | |
| 0 601 235 | 6/1994 | European Pat. Off. . | |
| 0 667 381 | 8/1995 | European Pat. Off. . | |
| 57-144563 | 7/1982 | Japan | 430/110 |

OTHER PUBLICATIONS

Fink et al, "UV curing powder coatings for heatsensitive substrates," European Coatings Journal, 1995, No. 9, pp. 606–608.

Witte, "Radiation curable powder coatings," European Coatings Journal, 1996, No. 3, pp. 115–117.

*Primary Examiner*—John Goodrow

*Attorney, Agent, or Firm*—Breiner & Breiner

[57] ABSTRACT

Toner particles comprising a toner resin are provided, characterised in that the toner resin comprises a radiation curable resin having a Tg≧35° C. The radiation curable resin is preferably a UV-curable resin and is a member selected from the group consisting of unsaturated polyester/polyurethaneacrylate mixture and unsaturated polyester/polyurethane-vinylether mixture. A method and an apparatus for forming radiation cured toner images are also provided.

10 Claims, No Drawings

RADIATION CURABLE TONER PARTICLES

This application claims benefit of Provisional Application Ser. No. 60/027,101, filed Sep. 25, 1996.

FIELD OF THE INVENTION

The present invention relates to toner particles comprising radiation curable compounds. It relates also to a method for producing toner images, wherein the toner images are highly resistant to wear.

BACKGROUND OF THE INVENTION

In imaging methods as e.g. electro(photo)graphy, magnetography, ionography, etc. a latent image is formed that is developed by attraction of so called toner particles. Afterwards the developed latent image (toner image) is transferred to a final substrate and fused to this substrate. In DEP the so called toner particles are imagewise deposited directly on a final substrate and fused to this substrate.

Toner particles are basically polymeric particles comprising a polymeric resin as main component and various ingredients mixed with said toner resin. Apart from colourless toners, which are used e.g. for finishing function, the toner particles comprise at least one black and/or colouring substances, e.g., coloured pigment.

In the different imaging methods, described above, the toner particles can be present in a liquid or in a dry developer composition.

In most cases the use of dry developer compositions is preferred. The main advantage of using a dry developer composition resides in the absence of the need to eliminate the liquid phase after development. The avoidance of the need to evacuate (mainly organic) liquids is desirable both from an economical standpoint and from an ecological standpoint.

However, in all techniques using dry particulate material to form an image, the images are built up by application of particulate marking elements in multiple, superimposed layers onto the substrate. The problems associated with multiple, superimposed layers of particulate marking particles that are in one way or another fixed on a substrate are manifold, not only with respect to image quality but also with respect to image stability and with respect to mechanical issues.

In, e.g. EP-A 471 894, EP-A 554 981, U.S. Pat. No. 4,828,950 and U.S. Pat. No. 4,885,603, it has been disclosed to apply a layer of transparent toner particles on top of the toner image to provide better resistance to physical damage.

In, e.g., U.S. Pat. No. 3,723,114 the problem of storage properties of fused toner images is addressed, the main problem being the fact that the toner images can, depending on the storage conditions, become tacky after storage. The problem is solved by using in the toner resin a substantial portion of thermosetting polymers.

The use of photo-curable toners has been suggested in, e.g., U.S. Pat. No. 5,470,683 to produce toner images having better weather resistance. In that application, a capsule toner is provided having a core comprising a polymerizable compound, a polymerization initiator and other normal toner ingredients. The core is surrounded by a hard shell that breaks during the fixing step. After the fixing step the polymerizable compound is polymerized, in this particular disclosure, by low energy visible light. Although following the teachings of these disclosures leads to the production of toner layers that are not easily damaged, the nature of the solutions itself limits the variety of resins that can be used in the manufacturing of the toner. Therefore further improvements along the lines of the disclosures referred to above are desirable.

OBJECTS AND SUMMARY OF THE INVENTION

It is an object of the invention to provide a method for producing toner images that are very resistant to external physical influences.

It is a further object of the invention to provide a method for forming toner images wherein said toner image is very resistant to the influence of common organic solvents.

It is a further object of the invention to provide a method for producing toner images that are very weather resistant.

It is a still further object of the invention to provide a method for producing toner images that are very resistant to external physical influences and that exhibit an even gloss.

Further objects and advantages of the present invention will become evident from the detailed description hereinafter.

The objects of this invention are realized by providing toner particles comprising a radiation curable compound, characterised in that said radiation curable compound having a Tg≧35° C.

DETAILED DESCRIPTION OF THE INVENTION

Since toner particles to be used in electrostatographic printing apparatus have preferably a quite high mechanical strength in order to be able to withstand the mechanical influences (pressure, friction, etc.) in the printing apparatus before and during development, it is important to preserve the mechanical strength of the toner particles.

Therefore it is preferred that the radiation curable compound, to be incorporated in toner particles according to this invention, comprises an oligomeric or polymeric compound instead of only monomeric compounds. A monomeric compound may be present in the mixture of radiation curable compounds, as long as the mixture of radiation curable compounds (i.e. a radiation curable composition) itself has a Tg≧35° C. The oligomeric or polymeric radiation curable compounds have a Tg≧35° C., preferably the Tg is larger than 40° C.

The radiation curable composition or compound can be added to the toner particles in addition to a toner resin and other toner ingredients. Due to the oligomeric or polymeric nature of the radiation curable compounds these compounds can also be used as sole toner resin. Although toner particles according to the present invention can be coloured (i.e. comprise a pigment or a dye) the toner particles of the present invention are especially useful when they are intended to form a clear finish layer on top of a toner image. When the clear toner particles according to the present invention are used to provide a clear finish layer on top of the image, an image with very even gloss is obtained. The word "clear" means herein not giving, in a wavelength range extending from 400 to 700 nm, a visible diffuse density, said visible diffuse density being defined as less than 15% light reduction integrated over that wavelength range. An "image on a substrate" is, in the context of this invention, meant to include a substrate carrying human readable or/and machine readable text, a substrate carrying figures, a substrate carrying pictures (both coloured and monochromatic) as well as a substrate carrying a combination of at least two of the above.

A clear finish layer can be useful on any toner image, but is especially useful when it is applied on top of a toner image showing different thickness in the image are mostly toner images made up by the overlay of several layers of different types of toner particles (e.g. in full colour toner images or in a black and white (monochrome) image with extended tonal range as disclosed in European Application 95202768, filed on Oct. 13, 1995). In such images a relief structure is present. Said clear finish layer can be produced by depositing said clear toner particles by an image-wise depositing step, a non-image-wise depositing step or a counter-image-wise depositing step. It is preferred that said clear toner particles are deposited either non-image wise (i.e. in a uniform layer over the whole surface of the substrate, having toner particles or not) or counter-image-wise. Counter-image-wise means that a thicker fixed clear finish layer is present in the lower thickness areas of the image and a thinner fixed clear finish layer is present in the higher thickness areas of the image.

When the image comprises both text and e.g. full-colour pictures, it may be beneficial to deposit said clear toner particles, according to this invention and comprising a radiation curable compound, only on the surface of the full-colour pictures and not over the text portions. In such a way glossy pictures are combined with less glossy text.

Although electron beam curable compounds can be used in the present invention, the radiation curable groups are preferably curable by UV-light.

Very useful radiation curable polymeric compounds, in toner particles for use in the present invention are UV curable solid epoxy resins with Tg≧35° C. as disclosed in EP-A 667 381. In this application solid compositions (I) are described containing (a) a solid, oligomeric, cationically polymerisable polyglycidyl ether or ester (II), or a mixture of (II) with a liquid or crystalline monomeric mono-, di- or poly-epoxy resin, or a mixture of (II) with a cyclic acetal, where (II) have a Tg of above 35 deg. C., (b) a multifunctional nucleophilic chain transfer agent, (c) 0.05–3 wt. % photoinitiator for cationic polymerisation (with respect to the amount of a), and (d) optionally normal additives for coating powders.

These compositions (I) are melted together and the cooled mixture is milled. The exemplified compositions have a Tg between 65 and more than 115° C.

Other useful UV curable resins for incorporation in toner particles, according to this invention, are powders based on unsaturated polyesters and polyurethaneacrylates, a typical example of such a polymeric UV curable system is available through Hoechts High Chem, Hoechts-Sara Pero (Mi) Italy. Such a system comprises a solid unsaturated polyester resin under trade name ALFTALAT VAN 1743, having a Tg≧52° C. and an urethane adduct with acrylic functional groups under trade name ADDITOL 03546, having a Tg≧47° C. The properties of this system have be described in European Coating Journal n° 9/95 606–608 (1995). Also non-acrylate binder systems are useful in the present invention, e.g. a powder composed of a mixture of an unsaturated polyester resin in which maleic acid or fumaric acid is incorporated and a polyurethane containing a vinylether. Such a binder system has been developed by DSM resins of the Netherlands and the properties thereof have been described in European Coating Journal n° 3/96 115–117 (1996).

For the UV curing to proceed it is necessary that a photoinitiator is present. Very useful initiators are sulphonium salts as e.g. triarylsulphonium salts, triarylsulphoniumhexafluorophosphate, benzophenones, etc. Typical very useful photoinitiators in the context of this invention, are, e.g., 2-hydroxy-2-methyl-1-phenyl-propan-1-one, compound I, a mixture of compound I and compound II and compound III

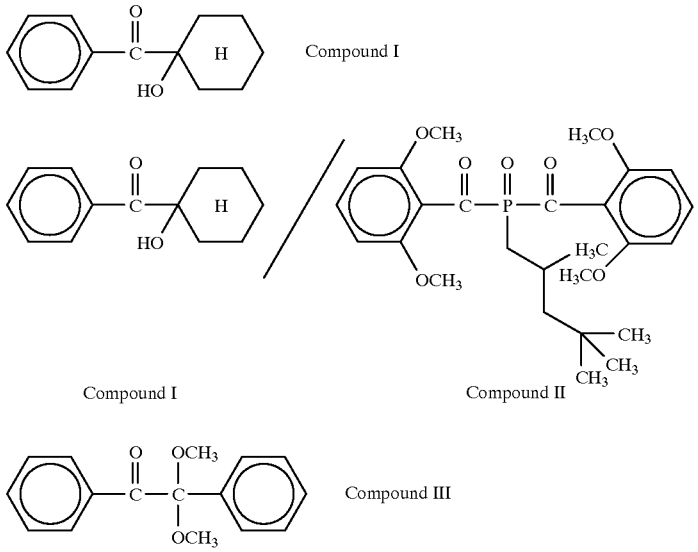

The initiator (photoinitiator) is preferably incorporated in the toner particles together with the UW curable system. It is, however, also possible, within the scope of the invention, to have the pair radiation curable compound and initiator in various combinations:

i) both a UV-curable compound (or a mixture of UV-curable compounds) and a photoinitiator (or mixture of photoinitiators) are only incorporated in the toner particles, not in the substrate, ii) both a UV-curable compound (or a mixture of UV-curable compounds) and a photoinitiator (or mixture of photoinitiators) are in incorporated in the toner particles, and a UW-curable compound (or a mixture of UV-curable compounds) is incorporated in the substrate, iii) a UV curable compound (or a mixture of UV-curable compounds) is incorporated in the toner particles and both a UW-curable compound (or a mixture of UV-curable compounds) and a photoinitiator (or mixture of photoinitiators) are incorporated in the substrate, iv) a UV curable compound (or a mixture of UV-curable compounds) is incorporated in the toner particles and a photoinitiator (or mixture of photoinitiators) is incorporated in the substrate. When the photoinitiator and/or the UV curable compound are incorporated in the substrate, it is preferred that the substrate comprises a toner receiving layer.

The toner particles according to the present invention may comprise the radiation curable resins (radiation curable compounds or compositions) that preferably are UV-curable resins as sole toner resin, or the radiation curable resins may be mixed with other toner resins. In that case all toner resins, known in the art are useful for the production of toner particles according to this invention. The resins mixed with the radiation curable resins can be polycondensation polymers (e.g. polyesters, polyamides, co(polyester/polyamides), etc.), epoxy resins, addition polymers or mixtures thereof.

It may be beneficial that the toner particles not only comprise a compound carrying a radiation curable group, but further comprise a reactive group RGA being a member selected from the group consisting of epoxy groups, aldehyde groups, hydroxyl groups, carboxyl groups, mercapto groups, amino groups and amide groups. In this case the toner particles can comprise e.g. a toner resin selected from the group described in table 1 or an epoxy resin and a UV curable solid resin (composition) with Tg≧35° C.

TABLE 1

| Chemical structure | AV* | HV** | Tg | Mn+ | Mw† |
|---|---|---|---|---|---|
| 1. Polyester resin of terephthalic acid, ethyleneglycol and DIANOL 22 | 3 | 31.1 | 62 | 3.6 | 10 |
| 2. Polyester resin of fumaric acid and DIANOL 33 | 17 | 5.2 | 55 | 4.4 | 12 |
| 3. Polyester resin of terephthalic acid, isophthalic acid and DIANOL 22 and ethyleneglycol | 18 | 20.9 | 60 | 4 | 18 |
| 4. Copoly(styrene-butylacrylate-butylmethacrylate-stearylmethacrylate-methacrylic acid) (65/5/21/5/4) | 12 | 0 | 58 | 6 | 108 |
| 5. Copoly(styrene-butylmethacrylate-acrylic acid) (80/15/5) | 5 | 0 | 63 | 5.5 | 180 |
| 6. Polyester resin of DIANOL 33/DIANOL 22, terephthalic acid and trimellitic acid | 30 | 50 | 65 | 2.0 | 14 |
| 7. Co(Styrene/n-butylmethacrylate), diCOOH terminated (65/35) | 15 | 0 | 48 | 2.1 | 10 |

*AV: acid value in mg KOH/g resin
**HV: hydroxyl value in mg KOH/g resin
+Mn: numerical average molecular weight (× 1000)
†Mw: weight average molecular weight (× 1000)
DIANOL 22 is a trade name of AKZO CHEMIE of the Netherlands for bis-ethoxylated 2,2-bis(4-hydroxyphenyl)propane.
DIANOL 33 is a trade name of AKZO CHEMIE of the Netherlands for bis-propoxylated 2,2-bis(4-hydroxyphenyl)propane.

In this embodiment of the invention, where the toner particles comprise further reactive groups RGA, it is preferred to use a substrate comprising a reactive group RGB, being a member selected from the group consisting of epoxy groups, aldehyde groups, hydroxyl groups, carboxyl groups, mercapto groups, amino groups and amide groups and being chosen such as to form a reaction pair with said reactive groups RGA. This embodiment has the advantage that the resins comprised in the fixed image can be not only radiation cured but also thermally cross-linked and chemically attached to the substrate by chemical bonds.

In the embodiment wherein the substrate comprises reactive groups RGB and the toner particles comprise not only radiation curable compounds having a Tg≧35° C., but also reactive groups RGA, it is preferred to add catalysers, speeding up the reaction between reactive groups RGA and RGB, to either the toner particle, the substrate or to both. These catalysers are e.g. acids (both organic and anorganic) and tertiary amines. Very suitable catalysers are p-toluenesulfonic acid, trimethylamine and triethylamine.

Toner particles according to the present invention can be prepared by any method known in the art. This toner particles can be prepared by melt kneading the toner ingredients (e.g. toner resin, charge control agent, pigment, etc.) and said radiation curable compounds. After the melt kneading the mixture is cooled and the solidified mass is pulverized and milled and the resulting particles classified. Also the "emulsion polymerisation" and "polymer emulsion" techniques for toner preparation can be used to prepare toner particles according to this invention. In the "emulsion polymerization" technique a water-immiscible polymerizable liquid is sheared to form small droplets emulsified in an aqueous solution, and the polymerization of the monomer droplets takes place in the presence of an emulsifying agent; such a technique is described e.g. in U.S. Pat. No. 2,932,629, U.S. Pat. No. 4,148,741, U.S. Pat. No. 4,314,932 and EP-A 255 716. In the "polymer emulsion" technique, a pre-formed polymer is dissolved in an appropriate organic solvent that is immiscible with water, the resulting solution is dispersed in an aqueous medium that contains a stabilizer, the organic solvent is evaporated and the resulting particles are dried; such a technique is described in, e.g., U.S. Pat. No. 4,833,060.

Toner particles useful in this invention can have an average volume diameter between 1 and 50 μm, preferably between 3 and 20 μm. When the toner particles are intended for use in colour imaging, it is preferred that the volume average diameter is between 3 and 10 μm, most preferred between 3 and 8 μm. The particle size distribution of said toner particles can be of any type. It is however preferred to have an essentially (some negative or positive skewness can be tolerated, although a positive skewness, giving less smaller particles than an unskewed distribution, is preferred) Gaussian or normal particle size distribution, either by number or volume, with a coefficient of variability (standard deviation divided by the average) (v) smaller than 0.5, more preferably of 0.3.

Toner particles, useful in this invention, can comprise any normal toner ingredient e.g. charge control agents, pigments both coloured and black, anorganic fillers, anti-slip agents, waxes, etc. A description of charge control agents, pigments and other additives useful in toner particles, to be used in a toner composition according to the present invention, can be found in e.g. EP-A 601 235.

The toner particles can be used as mono-component developers, both as a magnetic and as a non-magnetic mono-component developer. The toner particles can be use din a multi-component developer wherein both magnetic carrier particles and toner particles are present. The toner particles can be negatively charged as well as positively charged.

The present invention also includes a method for forming a toner image on a substrate comprising the steps of:

i) image-wise depositing toner particles comprising a radiation curable resin having a Tg≧35° C. on said substrate, ii) fusing said toner particles on said substrate and iii) radiation curing said fused toner particles.

The present invention further includes a method for forming a toner image on a substrate comprising the steps of:

i) image-wise depositing toner particles on a substrate, ii) depositing clear toner particles, comprising a radiation curable resin having a Tg≧35° C. on top of said image-wise deposited toner particles, iii) fusing said toner particles on said substrate and iv) radiation curing said fused toner particles.

The radiation curing can proceed on line, e.g, in the fusing station itself of an electrostatographic apparatus or in a station immediately adjacent to said fusing station.

The radiation curing can proceed off-line in a separate apparatus wherein the fused layer of toner particles is heated again and irradiated with curing rays. It is important that the radiation (UV-) curing proceeds on the molten toner particles and while the toner receiving layer has some fluidity. Preferably said radiation curing proceeds at a temperature that preferably is at most 150°, most preferably at most 120° C. Therefore it is preferred to use toner particles, comprising a radiation curable compound having a Tg≧35° C., that have a meltviscosity at 120° C. between 50 and 2000 Pas, preferably between 100 and 1000 Pas. All meltviscosities mentioned herein are measured in a RHEOMETRICS dynamic rheometer, RVEM-200 (One Possumtown Road, Piscataway, N.J. 08854 USA). The viscosity measurement is carried out at a sample temperature of 120° C. The sample having a weight of 0.75 g is applied in the measuring gap (about 1.5 mm) between two parallel plates of 20 mm diameter one of which is oscillating about its vertical axis at 100 rad/sec and amplitude of $10^{-3}$ radians. The fluidity of the toner receiving layer at the temperatures mentioned above can be increased by incorporating waxes or "heat solvents" also called "thermal solvents" or "thermosolvents" in the toner receiving layer on the substrate.

By the term "heat solvent" in this invention is meant a non-hydrolysable organic material which is in solid state at temperatures below 50° C. but becomes on heating above that temperature a plasticizer for the binder of the layer wherein they are incorporated. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1,1-dioxide, methyl anisate and 1,10-decanediol being described as heat solvents in Research Disclosure, December 1976, (item 15027) pages 26–28. Still other examples of heat solvents have been described in U.S. Pat. Nos. 3,438,776, and 4,740,446, and in published EP-A 0 119 615 and 0 122 512 and DE-A 3 339 810.

Said toner receiving layer may further comprise a binding agent or mixture of binding agents, also stabilizers, toning agents, antistatic agents, spacing particles (both polymeric or anorganic). In addition to said ingredients the toner receiving layer may contain other additives such as free fatty acids, antistatic agents, e.g. non-ionic antistatic agents including a fluorocarbon group as e.g. in $F_3C(CF_2)_6CONH(CH_2CH_2O)$—H, ultraviolet light absorbing compounds, white light reflecting and/or ultraviolet radiation reflecting pigments, and/or optical brightening agents.

Said step of depositing said clear toner particles can be an image-wise depositing step, a non-image-wise depositing step or a counter-image-wise depositing step, as described above. In a method wherein additionally to the step of image-wise depositing toner particles on a substrate, a step of depositing clear toner particles on the image is included, it is within the scope of this invention, although all toner particles may comprise a radiation curable resin, sufficient that only said clear toner particle comprise a radiation curable resin with Tg≧35° C.

The present invention also includes an apparatus for forming toner images on a substrate comprising:

i) means for image-wise depositing toner particles comprising a radiation curable resin having a Tg≧35° C. on a substrate, ii) means for fusing said toner particles on said substrate characterised in that it further comprises means for on-line radiation curing said fused toner particles.

The present invention further includes an apparatus for forming a toner image on a substrate comprising the steps of:

i) means for image-wise depositing toner particles on said substrate, ii) means for depositing clear toner particles, comprising a radiation curable resin having a Tg≧35° C. on top of said image-wise deposited toner particles, iii) means for fusing said toner particles on said substrate characterised in that it further comprises means for on-line radiation curing said fused toner particles.

Said means for fusing said toner particles to the substrate can be any means known in the art, the means for fusing toner particles according to this invention can be contact (e.g. hot-pressure rollers) or non-contact means. In an apparatus according to the present invention, however, the fusing means it is preferred to be mainly, preferably exclusively, non-contact means. Non-contact fusing means according to this invention can include a variety of embodiments, such as: (1) an oven heating process in which heat is applied to the toner image by hot air over a wide portion of the support sheet, (2) a radiant heating process in which heat is supplied by infrared and/or visible light absorbed in the toner, the light source being e.g. an infrared lamp or flash lamp. According to a particular embodiment of "non-contact" fusing the heat reaches the non-fixed toner image through its substrate by contacting the support at its side remote from the toner image with a hot body, e.g., a hot metallic roller. In the present invention, non-contact fusing by radiant heat, e.g., infrared radiation (IR-radiation), is preferred.

In a apparatus according to the present invention it is preferred to use toner particles comprising a UV-curable resin and thus the means for radiation curing the toner particles comprise are means for UV-curing (UV-light emitters as e.g. UV lamps). In an apparatus according to the present invention, it is preferred that the radiation curing proceeds on-line. Therefore it is preferred that said means for fusing said toner images emit infrared radiation (are infra-red radiators) and said means for UV curing (e.g. one or more UV emitting lamps as, e.g. high pressure mercury lamps) are installed immediately after said fusing means so that the UV curing proceed on the still molten toner image. A combination of infra-red radiators (the means for fusing the toner particles) and UV emitting lamps (the means for radiation curing) in a single station (a fixing/curing station), so that the fusing and the radiation curing proceed simultaneously, is also a desirable design feature of an apparatus according to this invention. The apparatus according to the present invention can comprise if so desired, more than one fixing/curing station. The UV emitting means are preferably UV radiators with a capacity (an intensity) between 20 W/cm and 150 W/cm.

The means for image-wise depositing toner particles can, in apparatus according to this invention, be direct electrostatic printing means (DEP), wherein charged toner particles are attracted to the substrate by an electrical field and the toner flow modulated by a printhead structure comprising printing apertures and control electrodes.

Said means for image-wise depositing toner particles can also be toner depositing means wherein first a latent image is formed. In such an apparatus, within the scope of the present invention, said means for image-wise depositing toner particles) comprise:

means for producing a latent image on a latent image bearing member, means for developing said latent image by the deposition of said toner particles, forming a developed image and means for transferring said developed image on said substrate.

Said latent image may be a magnetic latent image that is developed by magnetic toner particles (magnetography) or, preferably, an electrostatic latent image. Such an electrostatic latent image is preferably an electrophotographic latent image and the means for producing a latent image are in this invention preferably light emitting means, e.g., light emitting diodes or lasers and said latent image bearing member comprises preferably a photoconductor.

EXAMPLE

1. Preparation of the Toner Particles and the Developers

Yellow toner (Y)

49 parts of a polyester with acid value AV of 17 mg KOH/g (number 2 of Table 1) and 49 parts of a polyester with AV of 18 mg KOH/g (number 3 of Table 1) were melt-blended for 30 minutes at 110° C. in a laboratory kneader with 2 parts of SICOECHTGELB D 1355 DD (Colour Index PY 13, trade name of BASF AG, Germany).

After cooling the solidified mass was pulverized and milled using an ALPINE Fliessbettgegenstrahlmühle type 100AFG (tradename) and further classified using an ALPINE multiplex zig-zag classifier type 100MZR (tradename). The average particle size of the separated toner was measured by Coulter Counter model Multisizer (tradename) was found to be 8.0 $\mu$m by volume.

To improve the flowability of the toner mass the toner particles were mixed with 0.5% of hydrophobic colloidal silica particles (BET-value 130 $m^2/g$).

Magenta Toner (M)

The preparation of the Yellow toner was repeated, but instead of 2 parts SICOECHTGELB PY13, 2 parts of PERMANENT CARMIN FFB 02 (Colour Index PR146, tradename of Hoechst AG, Germany) were used.

Cyan toner (C)

The preparation of the Yellow toner was repeated, but instead of 2 parts SICOECHTGELB PY13, 2 parts of HELIOGEN BLAU D7072DD (Colour Index PB15:3, trade name of BASF AG, Germany) were used.

Black toner (K)

The preparation of the Yellow toner was repeated, but instead of 2 parts SICOECHTGELB PY13, 2 parts of CABOT REGAL 400 (carbon black, trade name of the Cabot Corp. High Street 125, Boston, U.S.A.) were used.

The four toners, Y, M, C and K had a meltviscosity at 120° C. of 250 Pas (measured as described above at a frequency of 16 Hz.

Clear toner (CT)

68 parts of solid unsaturated polyester resin having a Tg≧45° C. available from Hoechst High Chem, Hoechts-Sara, Pero (Mi) Italy under trade name ALFTALAT VAN 1743, 29 parts of an aliphatic urethane adduct with acrylic functional groups, having a Tg≧52° C., available from Hoechst High Chem, Hoechts-Sara, Pero (Mi) Italy under trade name ADDITOL 03546 and 3 parts of

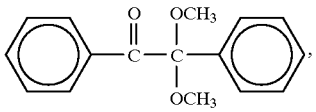

available from Ciba-Geigy, Basel, Switserland under tradename IRGACURE 651 were melt-blended for 30 minutes at 110° C. in a laboratory kneader.

After cooling the solidified mass was pulverized and milled using an ALPINE Fliessbettgegenstrahlmühle type 100AFG (tradename) and further classified using an ALPINE multiplex zig-zag classifier type 100MZR (tradename). The average particle size of the separated toner was measured by Coulter Counter model Multisizer (tradename) was found to be 8.0 $\mu$m by volume. The clear toner CT had a meltviscosity at 120° C. of 195 Pas.

To improve the flowability of the toner mass the toner particles were mixed with 0.3% of hydrophobic colloidal silica particles (BET-value 130 $m^2/g$).

Developers

Each of the above prepared toners were used to form carrier-toner developers by mixing said mixture of toner particles and colloidal silica in a 4% ratio with silicone-coated Cu-Zn ferrite carrier particles having an average diameter of 55 $\mu$m.

2. Printing Example

Full colour toner images were produced using a commercial CHROMAPRESS (a trade name of Agfa-Gevaert NV, Mortsel, Belgium). The images were covered with a layer of clear toner such that 0.9 $mg/cm^2$ clear toner was present.

The fusing took place with radiant heat (a IR-lamp) at 120° C. and the fused tone layer was immediately, without cooling irradiated with a UV-lamp for 0.5 sec with a high pressure mercury lamp and intensity of 80 W/cm.

A second image without UV-curing was also produced.

The resistance of both images against solvents was tested by rubbing the image 10 consecutive times with a cloth soaked with MEK (methylethyleketone). The UV-cured image, whereas the non-cured image disappeared after rubbing once.

The UV-cured image showed an even high gloss of more than 90% when measured under an angle of 60° with a gloss measuring device (MINOLTA MULTI-GLOSS 268, trade name of Minolta, Osaka, Japan).

We claim:

1. A method for forming a toner image on a substrate comprising the steps of:

i) image-wise depositing toner particles with a toner resin having one or more non-radiation-curable resins on a substrate, ii) depositing clear toner particles, comprising a radiation curable compound having a Tg≧35° C. on top of said image-wise deposited toner particles, iii) fusing said toner particles on said substrate and iv) radiation curing said fused toner particles.

2. A method according to claim 1, wherein said radiation curable compound is a radiation curable resin having a Tg≧35° C.

3. A method according to claim 2, wherein said radiation curable resin is an UV-curable resin and said toner particles further comprise a photoinitiator.

4. A method according to claim 3, wherein said UV-curable resin is a member selected from the group consisting of unsaturated polyester/polyurethane-acrylate mixture and unsaturated-polyester/polyurethane-vinylether mixture.

5. A method according to claim 3, wherein said photoinitiator is a member selected from the group of triarylsulphonium salts, triarylsulphoniumhexa-fluorophosphate, benzophenones, 2-hydroxy-2-methyl-1-phenyl-propan-1-one,

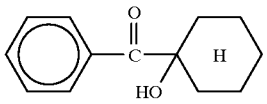

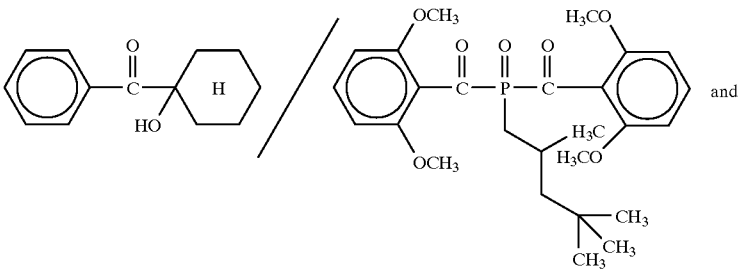

and

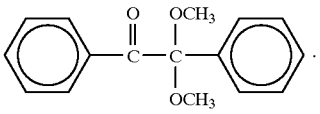

6. A method according to claim 1, wherein said toner particles with a toner resin consisting of one or more non-radiation-curable resins form an image with a relief and said clear toner particles, containing a radiation curable compound having a Tg≧35° C., are counter image-wise deposited on top of said image with a relief.

7. A method according to claim 6, wherein said radiation curable compound is a radiation curable resin.

8. A method according to claim 6, wherein said radiation curable resin is an UV-curable resin and said toner particles further comprise a photoinitiator.

9. A method according to claim 8, wherein said UV-curable resin is a member selected from the group consisting of unsaturated polyester/polyurethaneacrylate mixture and unsaturated polyester/polyurethane-vinylether mixture.

10. A method according to claim 8, wherein said photoinitiator is a member selected from the group of triarylsulphonium salts, triarylsulphoniumhexafluoro-phosphate, benzophenones, 2-hydroxy-2-methyl-1-phenyl-propan-1-one,

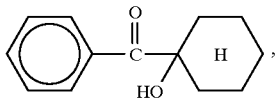

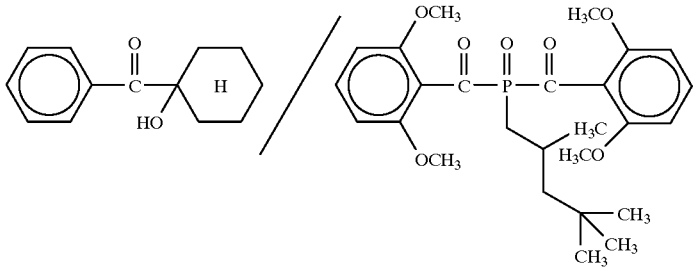

and

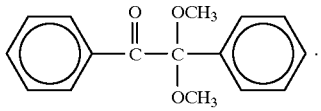

* * * * *